US010869136B2

(12) United States Patent
Zhang

(10) Patent No.: US 10,869,136 B2
(45) Date of Patent: Dec. 15, 2020

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 8 days.

(21) Appl. No.: 16/535,073

(22) Filed: Aug. 8, 2019

(65) Prior Publication Data

US 2020/0068314 A1 Feb. 27, 2020

(30) Foreign Application Priority Data

Aug. 24, 2018 (CN) ..... 2018 2 1391766 U

(51) Int. Cl.

| | |
|---|---|
| ***H04R 9/06*** | (2006.01) |
| ***H04R 9/02*** | (2006.01) |
| ***H04R 1/02*** | (2006.01) |
| ***H04R 7/18*** | (2006.01) |

(52) U.S. Cl.

CPC ..... *H04R 9/06* (2013.01); *H04R 1/021* (2013.01); *H04R 7/18* (2013.01); *H04R 9/025* (2013.01); *H04R 2400/11* (2013.01)

(58) Field of Classification Search

None

See application file for complete search history.

(56) References Cited

U.S. PATENT DOCUMENTS

| | | | | |
|---|---|---|---|---|
| 2014/0185839 | A1* | 7/2014 | Hashimoto | H04R 9/025 381/162 |
| 2018/0302722 | A1* | 10/2018 | Linghu | H04R 7/18 |
| 2018/0302724 | A1* | 10/2018 | Li | H04R 7/12 |
| 2018/0310094 | A1* | 10/2018 | Li | H04R 7/18 |

* cited by examiner

*Primary Examiner* — Tuan D Nguyen

(74) *Attorney, Agent, or Firm* — W&G Law Group LLP

(57) ABSTRACT

The present disclosure provides a speaker, which includes a frame having receiving space, a magnetic circuit system and a vibration system received in the receiving space. The vibration system includes a diaphragm and a voice coil, the magnetic circuit system includes a lower plate fixed to the frame, a primary magnet fixed on the lower plate, two secondary magnets disposed on both sides of the primary magnet, and an upper plate disposed on the secondary magnet, the upper plate includes a first surface facing towards the diaphragm, a second surface distal from the diaphragm, a fixing groove recessed from the second surface towards the first surface and a fixing hole. The fixing groove includes a bottom surface distal from the second surface. The fixing hole extends from the bottom surface to the first surface. The frame being injection-molded is filled in the fixing groove and the fixing hole.

10 Claims, 7 Drawing Sheets

SPEAKER

FIELD OF THE DISCLOSURE

The present disclosure relates to electro-acoustic transducers, and more particularly to a speaker applied in a portable electronic device.

DESCRIPTION OF RELATED ART

A speaker in the related art includes a frame, a vibration system and a magnetic circuit system. The magnetic circuit system includes a lower plate, a primary magnet, a secondary magnet received in the lower plate and an upper plate disposed on the secondary magnet. The upper plate is fixed to the frame.

In the related art, the upper plate is formed by injection molding with the frame. The upper plate and the frame are connected only by surface bonding.

When the scraps of the upper plate are removed after injection molding, cracks may be produced at the joint of the upper plate and the frame, which affects binding performance between the upper plate and the frame, and a bonding force is weakened. As such, the upper plate may be released and fall off from the frame during vibration, and hence performance of the speaker is affected.

Therefore, it is desired to provide a speaker to overcome the aforesaid problem.

BRIEF DESCRIPTION OF THE DRAWINGS

Many aspects of the exemplary embodiments can be better understood with reference to the following drawings. The components in the drawing are not necessarily drawn to scale, the emphasis is instead placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the present disclosure.

Figure 1:
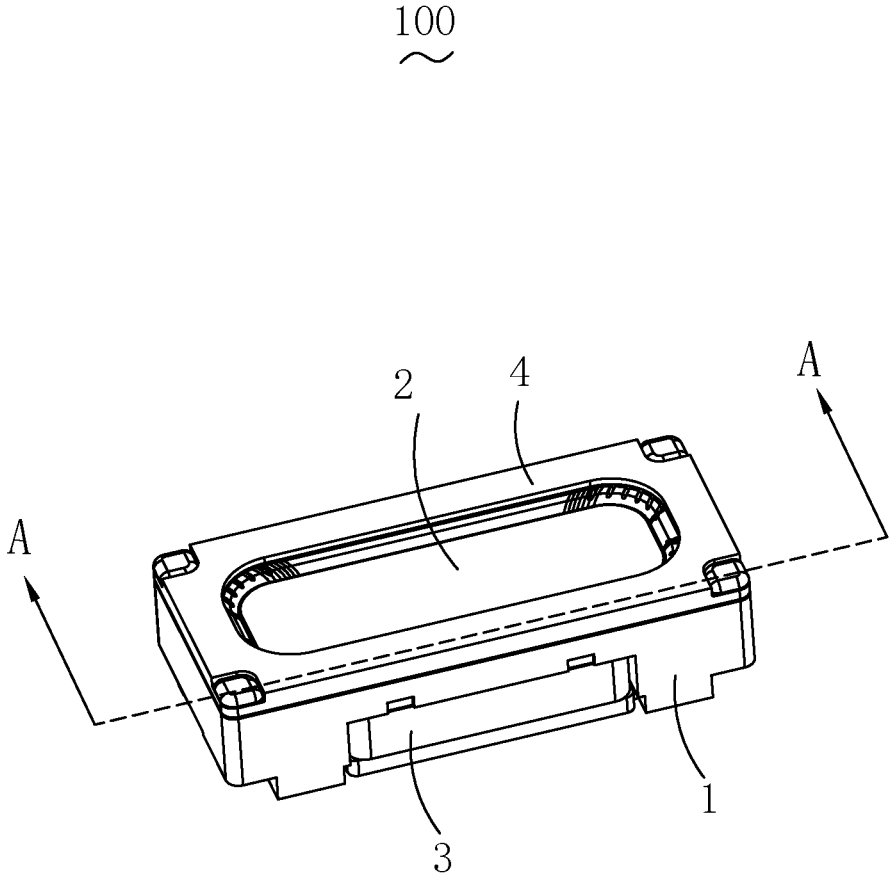
FIG. 1 is an isometric view of a speaker according to the present disclosure.
Figure 2:
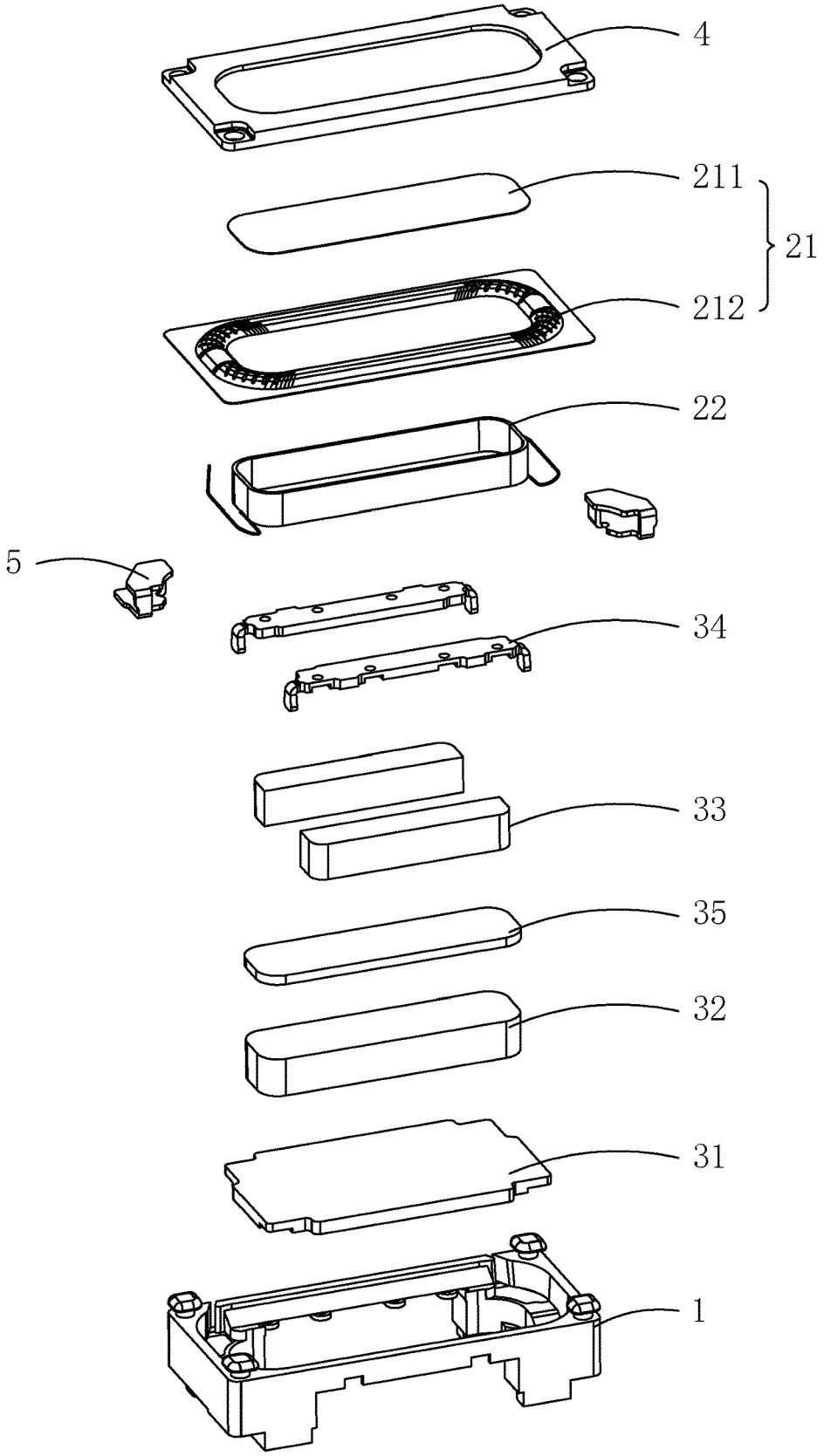
FIG. 2 is an exploded view of the speaker as illustrated in FIG. 1.

Referring to FIG. 1 and FIG. 2, FIG. 1 is an isometric view of a speaker according to an exemplary embodiment of the present disclosure, and FIG. 2 is an exploded view of the speaker as illustrated in FIG. 1. The present disclosure provides a speaker 100, which includes a frame 1 having a receiving space, a vibration system 2, a magnetic circuit system 3 and an upper cover 4. The vibration system 2, a magnetic circuit system 3 are accommodated in the receiving space of the frame 1. The cover plate 4 is fixed to the frame 1.

The vibration system 2 includes a diaphragm 21 configured to vibrate to produce sound, and a voice coil 22 configured to supply a drive force for the diaphragm 21. The speaker 100 further includes a conductive terminal 5 configured to connect the voice coil 22 to an external circuit. The diaphragm 21 is a two-piece diaphragm, and includes a dome 211 at a middle position and an edge 212 surrounding the dome 211. In another embodiment, the diaphragm 21 may also be an integral diaphragm.

The magnetic circuit system 3 includes a lower plate 31 fixed to the frame 1, a primary magnet 32 fixed to the lower plate 31, a secondary magnet 33 disposed on each side of the primary magnet 32 respectively, and an upper plate 34 disposed on the secondary magnet 33. A pole core 35 is further disposed on the primary magnet 32.

Figure 3:
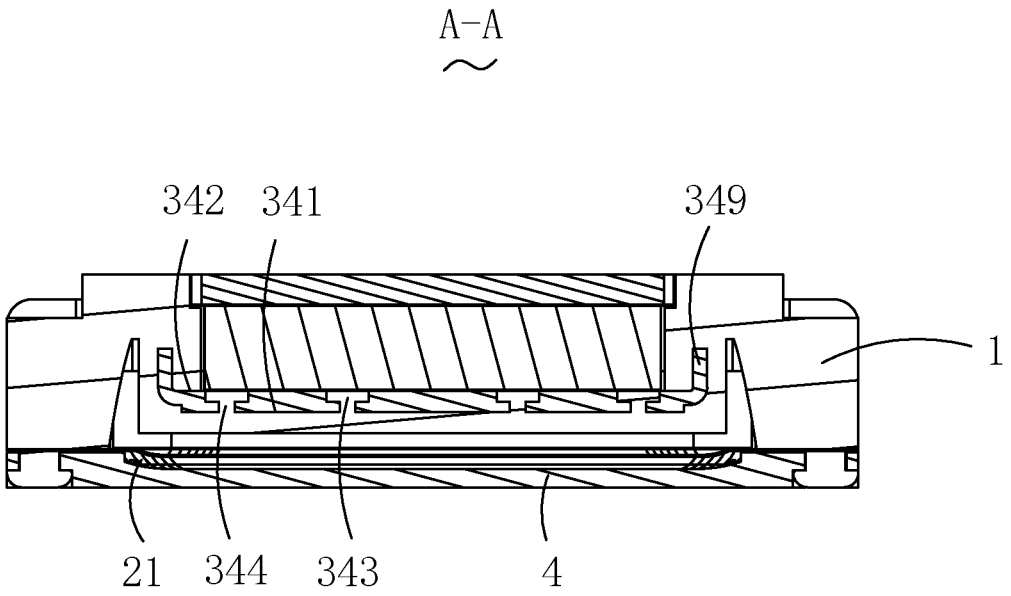
FIG. 3 is a perspective view taken along line A-A in the isometic view as illustrated in FIG. 1.

Referring to FIG. 3, the upper plate 34 includes a first surface 341 facing towards the diaphragm 21, a second surface 342 distal from the diaphragm 21, a fixing groove 343 recessed from the second surface 342 towards the first surface 341, a fixing hole 344, a third surface 345 proximal to the primary magnet 32, a fourth surface 346 distal from the primary magnet 32, an avoidance portion 347, an extension portion 348 and a bending portion 349. The fixing groove 343 includes a bottom surface 3431. The fixing hole 344 extends from the bottom surface 3431 to the first surface 341. A material of the frame 1 is filled in the fixing groove 343 and the fixing hole 344 by injection molding. The third surface 345 and the fourth surface 346 are parallel to a vibration direction, and the fixing groove 343 is recessed from the fourth surface towards the third surface.

In this embodiment, an area of an orthographic projection area of the fixing hole 344 along the vibration direction is less than an area of the bottom surface 3431. During the injection molding process, the material of the frame 1 in the fixing groove 343 and the fixing hole 344 is integrally formed with the frame 1, and the upper plate 34 and the frame 1 are firmly connected to enhance a bonding force between the upper plate 34 and the frame 1. In another embodiment, the area of the orthographic projection of the fixing hole 344 in the vibration direction may also be equal to the area of the bottom surface 3431 as long as an effect of holding and fixing is achieved.

Figure 4:
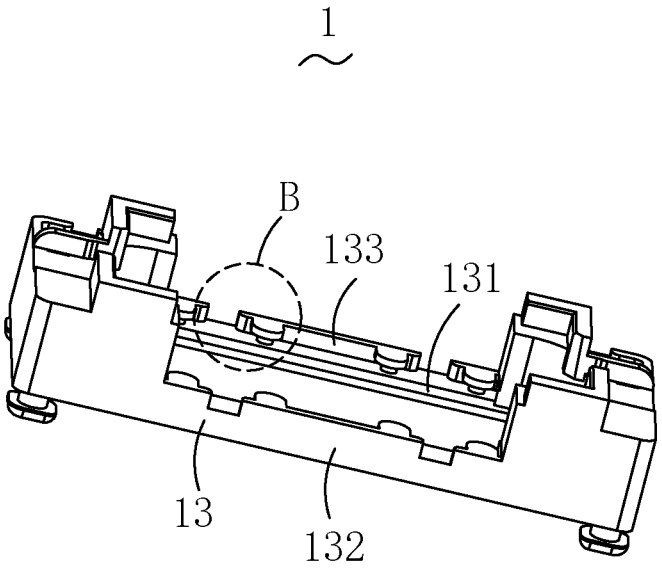
FIG. 4 is an isometic diagram of a frame in the speaker according to the present disclosure.
Figure 5:
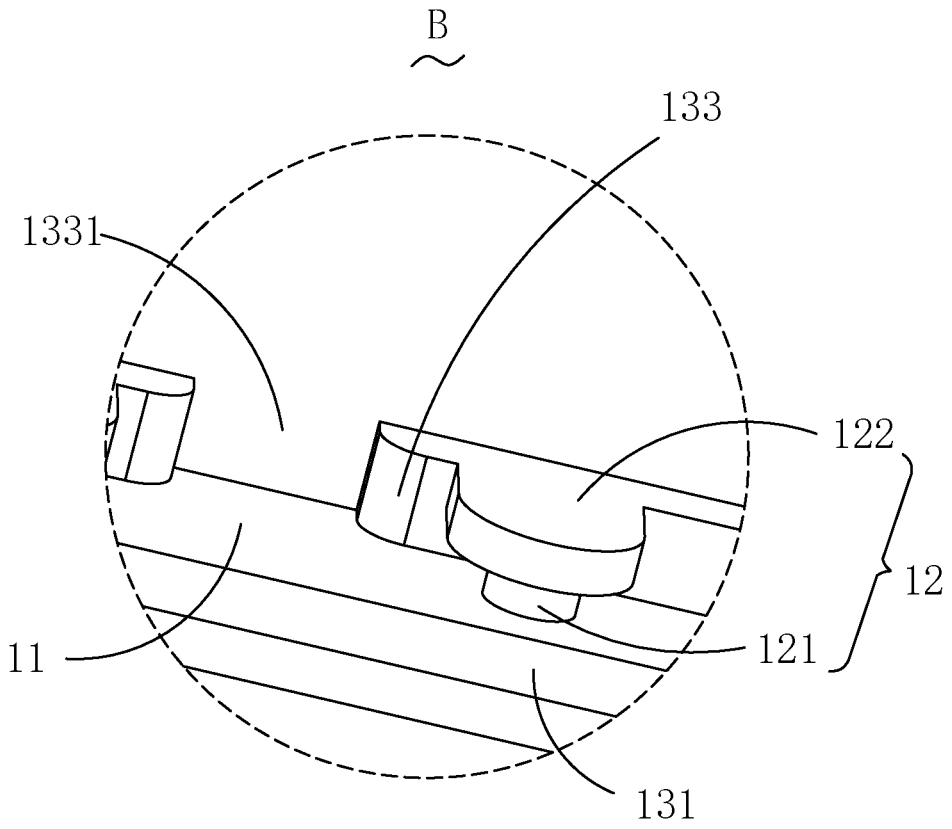
FIG. 5 is a partially enlarged view of part B in the exploded view as illustrated in FIG. 4.
Figure 6:
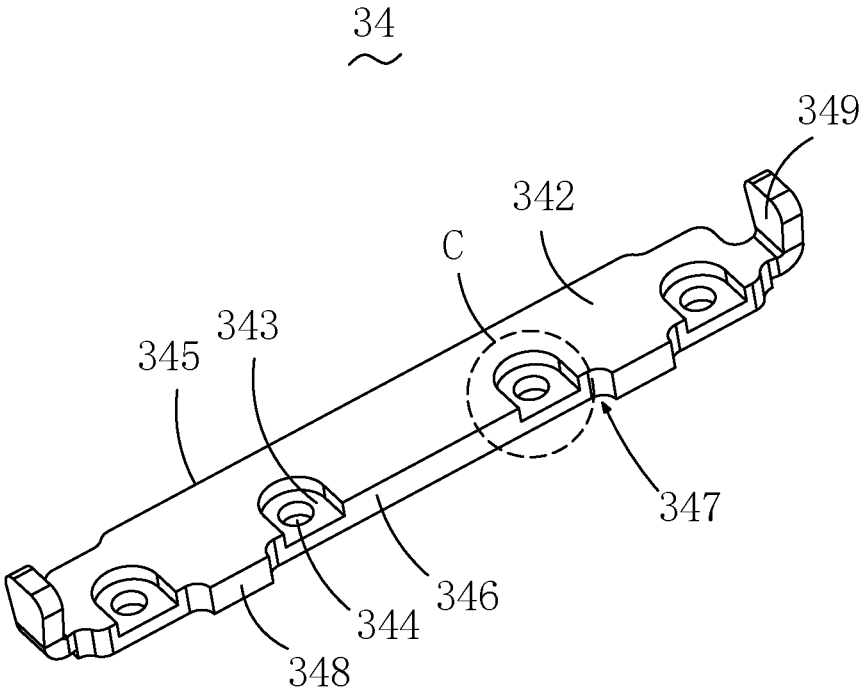
FIG. 6 is an isometric view of an upper plate as illustrated in FIG. 2.
Figure 7:
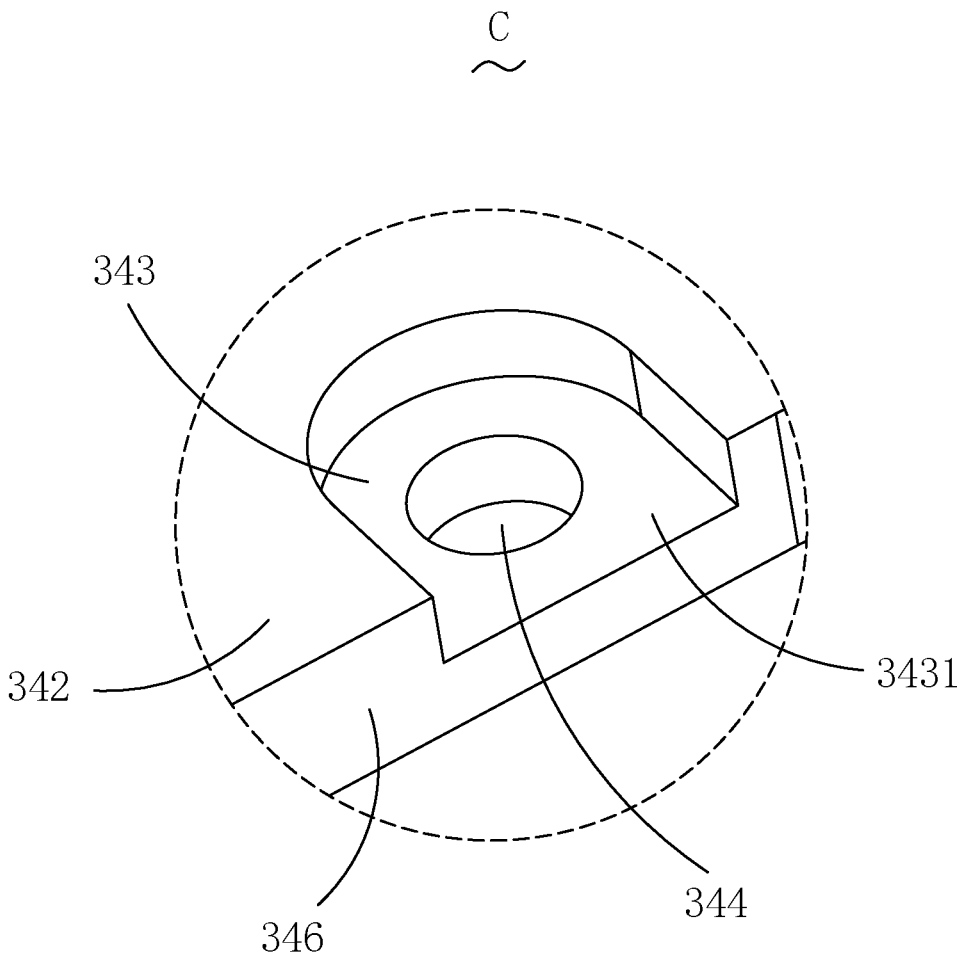
FIG. 7 is a partially enlarged view of the part C in the isometric view as illustrated in FIG. 4.

Referring to FIG. 4 and FIG. 5, the frame 1 includes a first bottom wall 11 opposite to the first surface 341, a fixing structure 12 and a first side portion 13 fixedly connected to the upper plate 34. The first bottom wall 11 extends distally from the diaphragm 21 to form the fixing structure 12 fixedly connected to the upper plate 34. The fixing structure 12 includes a first fixing structure 121 received in the fixing hole 344 and a second fixing structure 122 received in the fixing groove 343. The first side portion 13 includes a first inner wall 131 proximal to the primary magnet 32, a first outer wall 132 distal from the primary magnet 32 and a side wall 133. The first inner wall 131 and the first outer wall 132 are both parallel to the vibration direction, and the first bottom wall 11 connects the first inner wall 131 to the first outer wall 132. The first side wall 133 extends from the first outer wall 132 towards the diaphragm 21, and is parallel to the vibration direction.

The fixing groove 343 is excessed from the fourth surface 346 towards the third surface 345. The avoidance portion 347 is excessed from the fourth surface 346 towards the third surface 345, and is connected to the fixing groove 343. The second fixing structure 122 extends from the first side wall 133 towards the primary magnet 32 horizontally along a direction perpendicular to the vibration direction. An end of the second fixing structure 122 proximal to the primary magnet 32 is connected to the first fixing structure 121, and the second fixing structure 122 is fixedly caught in the fixing groove 343.

At least two fixing grooves 343 are disposed, and the number of the fixing structures 12 is consistent with the number of the fixing grooves 343, the fixing structure 12 is disposed correspondingly to the fixing groove 343.

In this embodiment, four fixing grooves 343 are disposed; the extension portion 348 of the upper plate 34 extends horizontally from the fourth surface 346 towards the first outer wall 132, and the extension portion 348 is spaced apart from the first outer wall 132. That is, the extension portion 348 does not extend to the first outer wall 132. The extension portion 348 is disposed between two adjacent avoidance portions 347. The first side wall 133 is provided with a notch 1331 for configured to receive the extension portion 348. During injection molding, the injection scrap of the upper plate 34 is removed from the extension portion 348.

In addition, both ends of the bending portion 349 bent and extend distally from the diaphragm 21, and the bending portion 349 is fixedly caught in the frame 1.

Compared with the related art, in the speaker 100 according to the present disclosure, fixing grooves and fixing holes are provided on the upper plate, and the frame is provided with a first fixing structure connected with the frame and a second fixing structure extending from the first fixed structure. The first fixing structure is fixed in the fixing hole. The second fixing structure is fixed in the fixing groove. A width of the fixing groove is larger than a width of the fixing hole. With such structure, a bonding area between the upper plate and the frame is increased, and thus, the bonding force therebetween is enhanced.

When the scraps of the upper plate are removed after injection molding, the junction between the upper plate and the frame is not separated by an external force, which effectively improves the firmness and stability of the junction, and thus improves the vibration stability of the speaker.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A speaker, comprising:
- a frame having a receiving space;
- a magnetic circuit system accommodated in the receiving space, which comprising:
  - a lower plate fixed to the frame;
  - a primary magnet fixed on the lower plate;
  - a secondary magnet disposed on each side of the primary magnet; and
  - an upper plate attached on the secondary magnet;
- a vibration system received in the receiving space, which comprising:
  - a diaphragm configured to vibrate to produce sound via irradiation;
  - a voice coil configured to supply a driving force to the diaphragm; and
  - wherein the upper plate comprises a first surface facing towards the diaphragm, a second surface distal from the diaphragm, at least one fixing groove recessed from the second surface towards the first surface, and a first fixing hole, the fixing groove comprising a bottom surface, the first fixing hole extending from the bottom surface towards the first surface, a material of the frame being filled in the fixing groove and the first fixing hole by injection molding.

2. The speaker according to claim 1, wherein the frame comprises a first bottom wall opposite to the first surface, the first bottom wall extending distally from the diaphragm to form a fixing structure fixedly connected to the upper plate, the fixing structure comprises a first fixing structure received in the fixing hole and a second fixing structure received in the fixing grooves.

3. The speaker according to claim 2, wherein the upper plate further comprises a third surface proximal to the primary magnet and a fourth surface distal from the primary magnet, the third surface and the fourth surface being parallel to a vibration direction, the fixing groove being recessed from the fourth surface toward the third surface.

4. The speaker according to claim 3, wherein the frame comprises a first side portion fixedly connected to the upper plate, the first side portion comprising a first outer wall distal from the primary magnet and a first inner wall proximal to the primary magnet, the first inner wall and the first outer wall being both parallel to the vibration direction, the first bottom wall connecting the first inner wall to the first outer wall, and the first side portion further comprising a first side wall away from the diaphragm and extends as being parallel to the vibration direction, the second fixing structure horizontally extending from the first side wall in a direction perpendicular to the vibration direction towards the primary magnet, the second fixing structure is connected to the first fixing structure.

5. The speaker according to claim 4, wherein the upper plate comprises an avoidance portion recessed from the fourth surface toward the third surface, and the avoidance portion is coupled to the fixing groove.

6. The speaker according to claim 1, wherein an area of an orthographic projection of the fixing hole in a vibration direction is less than or equal to an area of the bottom surface.

7. The speaker according to claim 1, wherein an amount of the fixing groove is at least two.

8. The speaker according to claim 7, wherein the upper plate further comprises an extension portion extending horizontally from the fourth surface toward the first outer wall, the extension portion being disposed between two adjacent avoidance portions.

9. The speaker according to claim 8, wherein the first side wall includes a notch configured to receive the extension portion.

10. The speaker according to claim 1, wherein the upper plate further comprises a bending portion bending and extending from the both ends of the upper plate away from the diaphragm, the bending portion being nested in the frame.

* * * * *